US008631864B2

(12) United States Patent
Saenger et al.

(10) Patent No.: US 8,631,864 B2
(45) Date of Patent: Jan. 21, 2014

(54) DURABILITY OF DOWNHOLE TOOLS

(75) Inventors: Richard Saenger, Chatillon (FR); Jean Desroches, Paris (FR); Natalia Quisel, Paris (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 400 days.

(21) Appl. No.: 12/867,313

(22) PCT Filed: Feb. 6, 2009

(86) PCT No.: PCT/IB2009/000241

§ 371 (c)(1),
(2), (4) Date: Oct. 27, 2010

(87) PCT Pub. No.: WO2009/101507

PCT Pub. Date: Aug. 20, 2009

(65) Prior Publication Data

US 2011/0061945 A1 Mar. 17, 2011

(30) Foreign Application Priority Data

Feb. 15, 2008 (EP) ..... 08305025

(51) Int. Cl.
*E21B 17/10* (2006.01)

(52) U.S. Cl.
USPC ..... 166/241.2; 175/40; 175/371; 175/374; 175/434

(58) Field of Classification Search
None
See application file for complete search history.

(56) References Cited

U.S. PATENT DOCUMENTS

| | | | | |
|---|---|---|---|---|
| 4,783,995 | A * | 11/1988 | Michel et al. | 73/152.05 |
| 6,450,271 | B1 * | 9/2002 | Tibbitts et al. | 175/374 |
| 6,942,043 | B2 * | 9/2005 | Kurkoski | 175/40 |
| 7,385,401 | B2 * | 6/2008 | Itskovich et al. | 324/357 |
| 7,600,419 | B2 * | 10/2009 | Oddie | 73/152.18 |
| 7,918,274 | B2 * | 4/2011 | Thornton | 166/241.2 |
| 2002/0041930 | A1 | 4/2002 | Erdemir | |
| 2004/0031624 | A1 | 2/2004 | Scott | |
| 2008/0236842 | A1 * | 10/2008 | Bhavsar et al. | 166/381 |

FOREIGN PATENT DOCUMENTS

| | | |
|---|---|---|
| EP | 1788104 | 5/2007 |
| WO | 2007091054 | 8/2007 |

* cited by examiner

*Primary Examiner* — Giovanna Wright
*Assistant Examiner* — Marwan Bashir
(74) *Attorney, Agent, or Firm* — Stephanie Chi; Brigitte Jeffery Echols

(57) ABSTRACT

An apparatus for downhole operation. The apparatus comprising a support body having a surface located in a borehole and a coating on an at least a portion of the surface of the support body. The coating is an inert material selected for reducing friction and corrosion.

13 Claims, 3 Drawing Sheets

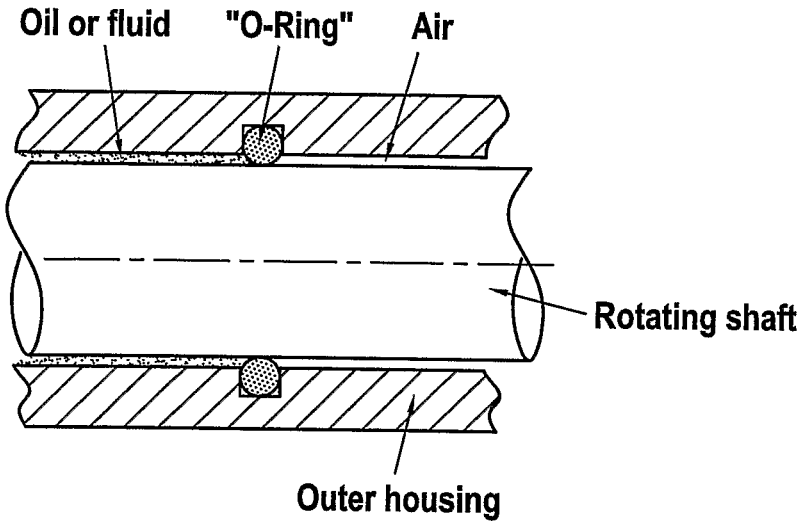
FIG.5
FIG.6
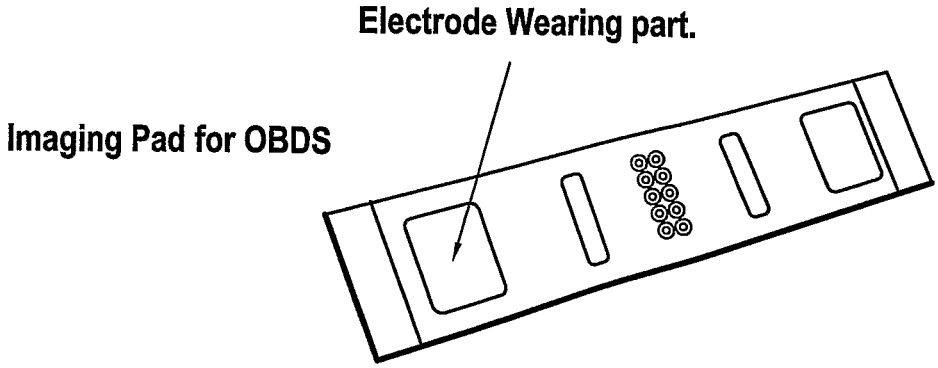

DURABILITY OF DOWNHOLE TOOLS

FIELD OF THE INVENTION

The present invention relates to a downhole apparatus and in particular, but not exclusively, to a downhole tool having a suitable coating.

BACKGROUND OF THE INVENTION

Downhole tools in the oil industry typically consist of metallic parts that are often moving and chafing against one another or the borehole wall or the mud/hydrocarbon fluid mix passing through or alongside the surfaces of such downhole tools. As a result corrosion occurs. Such downhole tools can take on various forms including drill collars, Logging While Drilling (LWD) tools, imaging tools having electrode pads, etc.

These downhole tools have metallic bodies with surfaces that are exposed to various types of corrosion:

- Electrochemical corrosion can occur when a metal is immersed in a conductive medium.
- Galvanic or bimetallic corrosion occurs when two metals in contact are immersed in the same fluid.
- Concentration cell corrosion occurs when the same metal is immersed in a fluid, the composition of which varies from one point to another.
- Pitting is a type of corrosion involving loss of metal in localized areas, thus forming small sharp cavities. It involves two electrochemical reactions: dissolving the metal into ions and turning oxygen atoms into oxide ions. Pitting requires 3 components to take place: Chlorides (bromides are even worse), Moisture and Oxygen.
- Other corrosion processes that can cause problems downhole are stress corrosion, hydrogen embrittlement and chemical corrosion.

It has been estimated that 1% of the total operating costs of the petroleum industry could be saved by correct application of existing corrosion protection technology. These are particular useful savings considered in light: of the magnitude of the operating costs in this industry. Corrosion control is particularly cost-effective for deep or remote wells, those expected to have a long lifetime or for wells producing carbon dioxide $CO_2$ or hydrogen sulfide $H_2S$.

All types of corrosion mechanisms can be observed during the drilling operation. In particular, in case of logging while drilling, the logging tool stays in contact with different types of mud for a long time. Most water-based muds are considered as a corrosive environment because they contain Chlorides (typically sodium chloride NaCl, and also potassium chloride KCl). If mud systems have foaming tendencies, or a few air bubbles are taken into the pumps, the oxygen dissolved at high-pressure and can also lead to severe corrosion. pH and temperature both act as catalysts for the corrosion reactions. In addition, non-corrosive metal loss can be caused by abrasion from circulating fluids and solids or by mechanical wear. Hydrogen sulfide, carbon dioxide, oxygen and chloride ions are known to enhance corrosion, though the mechanisms by which they act are very different.

Corrosion can be reduced by reduced corrosion resistant metals, but manufacturing the drilling tool parts out of such materials can be costly and precludes existing tools. It is also possible to protect against certain type of corrosion by introducing chemical inhibitors into the mud/hydrocarbon fluid, but this requires a delivery system to inject the chemical inhibitors and also time for the chemical processes to occur.

It is therefore desirable to mitigate against corrosion of downhole tools, which overcomes the aforementioned disadvantages.

SUMMARY OF THE INVENTION

According to one aspect of the present invention there is provided an apparatus for downhole operation, the apparatus comprising: a body having a surface located in a borehole; a coating on an at least a portion of the surface of the body, wherein the coating is an inert material selected for reducing friction.

The advantage of using a coating of an inert material is that not only is corrosion reduced for a downhole tool, but friction is also reduced, which is especially beneficially for moving surfaces.

A further advantage of the inert coating is that a thinner coat can be applied to the surface of the tool, while still improving the friction and corrosion as compared to other previously used materials. Thus, a thinner coating is also advantageous in that costs can be reduced, since the material volume is lower, while still extending the life of the downhole equipment.

Preferably, wherein the inert material is selected for reducing both friction and corrosion.

Preferably, wherein the inert material is at least one of a Diamond Carbon (DC) and a Diamond-like Carbon (DLC) film.

Preferably, wherein a second body of the tool having an inert coating on at least a portion of the surface of the second body such that when the inert coating of the body comes into contact with the inert coating of the second body, the friction is considerably reduced.

According to another aspect of the present invention there is provided a method for reducing friction on a downhole tool, the method comprising: depositing a coating of an inert material on the surface of the downhole tool; and operating the tool within the borehole with reduced friction.

A further advantage of the coating applied to downhole tools also means that legacy equipment can be equipped with such a coating and upgraded to improve the tool's operating life, rather then being discarded. Yet a further advantage of such coatings is the enhancement of the wear resistance as well as corrosion resistance of the tool, which further extends the lifetime of the tools.

BRIEF DESCRIPTION OF THE DRAWINGS

Embodiments of the present invention will now be described by way of an example with reference to the accompanying drawings, in which:

FIG. 5 shows an example of a rotating shaft application; and

FIG. 6 shows an example applied to pads of an imaging tool.

DETAILED DESCRIPTION OF EMBODIMENTS OF THE INVENTION

In the following detailed description of the preferred embodiments, reference is made to the accompanying drawings, which form a part hereof, and within which are shown by way of illustration specific embodiments by which the invention may be practiced. It is to be understood that other embodiments may be utilized and structural changes may be made without departing from the scope of the invention.

Figure 1:
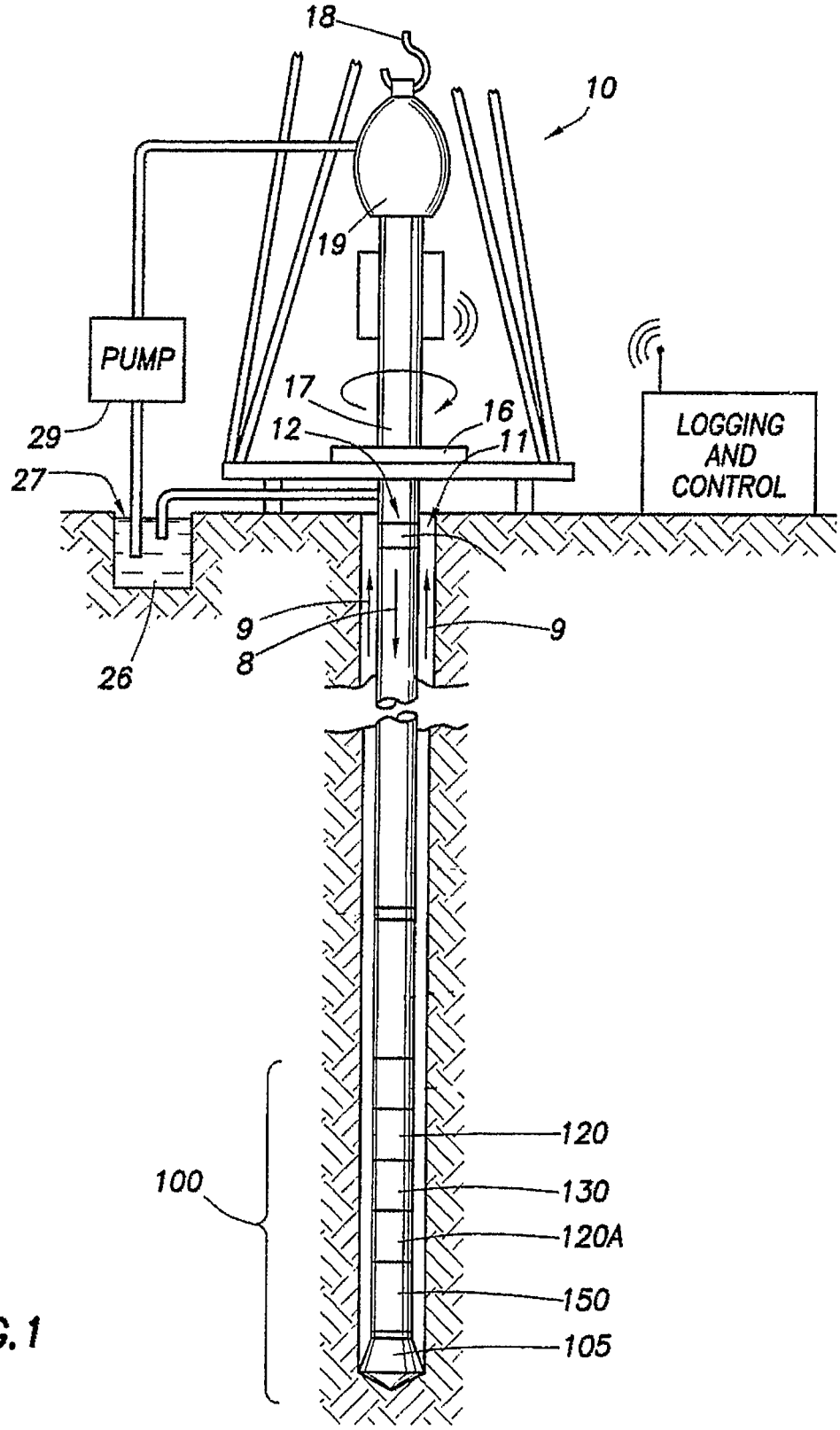
FIG. 1 shows a wellsite system in which an embodiment of the present invention can be employed.

FIG. 1 illustrates a wellsite system in which the present invention can be employed. Specifically the invention is concerned with downhole apparatus of all kinds, i.e. the apparatus dealing with drilling tools, measurement tools, logging tools, etc. Specifically, such tools operate in a downhole environment where there is a lot of debris against the surfaces of the tool. The coating extends the lifetime and maneuverability of these tools by coating surfaces of the tools with a material which reduced friction and corrosion.

The exemplary wellsite shown in FIG. 1 can be onshore or offshore. In this exemplary system, a borehole 11 is formed in subsurface formations by rotary drilling in a manner that is well known. Embodiments of the invention can also use directional drilling, as will be described hereinafter.

A drill string 12 is suspended within the borehole 11 and has a bottom hole assembly 100 which includes a drill bit 105 at its lower end. The surface system includes platform and derrick assembly 10 positioned over the borehole 11, the assembly 10 including a rotary table 16, kelly 17, hook 18 and rotary swivel 19. The drill string 12 is rotated by the rotary table 16, energized by means not shown, which engages the kelly 17 at the upper end of the drill string. The drill string 12 is suspended from a hook 18, attached to a traveling block (also not shown), through the kelly 17 and a rotary swivel 19 which permits rotation of the drill string relative to the hook. As is well known, a top drive system could alternatively be used.

In the example of this embodiment, the surface system further includes drilling fluid or mud 26 stored in a pit 27 formed at the well site. A pump 29 delivers the drilling fluid 26 to the interior of the drill string 12 via a port in the swivel 19, causing the drilling fluid to flow downwardly through the drill string 12 as indicated by the directional arrow 8. The drilling fluid exits the drill string 12 via ports in the drill bit 105, and then circulates upwardly through the annulus region between the outside of the drill string and the wall of the borehole, as indicated by the directional arrows 9. In this well known manner, the drilling fluid lubricates the drill bit 105 and carries formation cuttings up to the surface as it is returned to the pit 27 for recirculation.

The bottom hole assembly 100 of the illustrated embodiment a logging-while-drilling (LWD) module 120, a measuring-while-drilling (MWD) module 130, a roto-steerable system and motor, and drill bit 105. The LWD module 120 is housed in a special type of drill collar, as is known in the art, and can contain one or a plurality of known types of logging tools. It will also be understood that more than one LWD and/or MWD module can be employed, e.g. as represented at 120A. (References, throughout, to a module at the position of 120 can alternatively mean a module at the position of 120A as well.) The LWD module includes capabilities for measuring, processing, and storing information, as well as for communicating with the surface equipment.

The MWD module 130 is also housed in a special type of drill collar, as is known in the art, and can contain one or more devices for measuring characteristics of the drill string and drill bit. The MWD tool further includes an apparatus (not shown) for generating electrical power to the downhole system. This may typically include a mud turbine generator powered by the flow of the drilling fluid, it being understood that other power and/or battery systems may be employed. In the present embodiment, the MWD module includes one or more of the following types of measuring devices: a weight-on-bit measuring device, a torque measuring device, a vibration measuring device, a shock measuring device, a stick slip measuring device, a direction measuring device, and an inclination measuring device.

In a preferred embodiment of the present invention, the effects of corrosion of downhole tools are reduced by applying a protecting coating. Specifically, the protective coating being selected from an inert material and applied to a surface of at least a section of the tool such that is able to mitigate against the effects of corrosion. An inert material is a material that does not react with the environment under borehole conditions and prevents corrosion of the substrate in typical well environments.

Thus according to an embodiment of the present invention, coatings made from various inert materials exhibit anti-corrosive properties, but more importantly also exhibit low friction coefficient properties that would be especially useful in the field of downhole tools where there are moving parts and/or fluids.

Specifically, two inert materials that showed best results for coatings of downhole were the DC and DLC films. That is, these coating exhibit ideal properties of interest for tribology, the science of interactive surfaces in relative motion (friction, wear, lubrication and contact mechanics).

Figure 2:
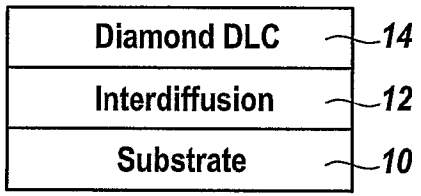
FIG. 2 shows a diagram of a DLC coating applied to the metal substrate according to an embodiment of the invention.

FIG. 2 shows a DLC coating 14 applied to a substrate 10. It should be appreciated that the substrate is likely to be the metal surface of the downhole tool to which the coating is to be applied. Also, FIG. 1 shows an interface layer 12 representing the chemical process that bonds the DLC coating 6 to the underlying substrate 2.

Various deposition techniques are possible for coating the substrate. One form of deposition is where a so-called 'thin' film of between 1-50 μm directly deposited on the final substrate. An alternative form pertains to so-called 'thick' films of between 200 μm-2 mm obtained through a three-stage deposition process: i) deposition on an optimum substrate (copper, silicon, etc), ii) elimination of the substrate and iii) brazing the thick film on the final substrate.

The interface layer 12 between the substrate 10 and coating 14 is typically a metallic layer deposited via (CVD or PVD—Chemical Vapor Deposition or Physical Vapor Deposition), which typically has a linear thermal expansion coefficient to suppress the scaling effects of the harder diamond layer 14. Preferably such an intermediate layer 12 enhances the adherence of the Diamond or DLC layer 14 to the substrate 10. In one embodiment, the intermediate layer 12 is preferably composed of one layer, but in other embodiments could also be a succession of layers with decreasing linear thermal coefficients.

It is also possible for thin film deposition to try and optimize the properties of the resulting DC/substrate or DLC/substrate pair which depend on many parameters. That is, the optimization of the film characteristics such as the roughness, the residual stress and the film adhesion required to master these parameters.

According to one embodiment a DC film was used, which is an inert material composed of carbon atoms whose hybridization is $sp^3$ (which is a way of expressing the bonding of the atoms in which each atom allows four neighboring carbons inside a tetrahedral site). Its crystalline structure is of a blend type (cubic base) with the lattice parameter equal to 0.354 nm. Its mechanical, optical, electronic and thermal properties are exceptional (it is both an electrical insulator and a excellent thermal drain). Table 1 shown below gives its principal properties of interest for tribology. DC film properties are compared with best in class materials for hardness and thermal conductivity.

TABLE 1

Properties of diamond presenting an interest in tribology.

| | DC | Others |
|---|---|---|
| Mechanical properties | | |
| Hardness (kg/mm$^2$) | 9000 | WC (tungsten carbide): 2200; BN-c (cubic boron nitride): 4500 |
| Friction coefficient | 0.1 (air); 1.0 (vacuum) | — |
| Young modulus (GPa) | 1230 | — |
| Thermal properties | | |
| Conductivity (W/cm · K) | 20 | Cu: 5 |
| Expansion (° C.$^{-1}$, at 400° C.) | 3.5 | — |
| Stability versus | | |
| oxidation (° C.) | 600 | — |
| graphitization (° C.) | 1400 | — |

In an alternative embodiment, a DLC film is used which is also an inert material. This material is constituted of carbon atoms whose hybridization is sp$^3$ (diamond) or sp$^2$ (graphite). Due to the presence of Csp$^3$, this material is hard (3000-4000 Hv). Two forms can be distinguished, depending on the Csp$^3$/Csp$^2$ ratio and the amount of hydrogen: i) a-C:H where the hydrogen percentage is close to 50% and ii) a-C where the hydrogen percentage is lower, and where the carbon atoms are mainly of the sp$^2$ hybrid type. Diamond-like carbon (DLC) is a meta-stable amorphous material characterized by attractive optical, electrical, chemical, and tribological properties. DLC films can be prepared at low temperatures (as low as 180 deg-C) from a large variety of precursors, and can be modified by the incorporation of different elements such as N (Nickel), F (Fluorine), Si (Silicon), or metals. The films are characterized by infrared transparency, a significant optical gap, high electrical resistivity, low dielectric constant, high hardness and internal compressive stresses, low friction coefficients, and chemical inertness.

The DLC coatings can improve significantly the anti-corrosion properties of the material used to manufacture critical parts of the logging tools likely to be affected by corrosion, or to prevent galling and seizing in the case of contact between two metal pieces.

It should also be understood that DLC films are chemically inert to practically any solvent and are not attacked by acids, alkalis, or organic solvents (at room temperature). The films are inert even to strong acid mixtures, such as the "acid etch" ($HNO_3$:HF=7:2) and to exposure to alkali solutions at 85° C. for several hours. DLC films deposited on ferrous material can also prevent corrosion due to hydrogen sulfide.

Thus, the inert protective coating not only prevents corrosion of the sensitive parts of logging tools, but furthermore reduces friction both between metallic parts of the downhole tool and/or between the downhole tool and the formation itself.

Concerning the friction coefficient, DC and DLC present very low values but several differences appear among these hard carbon coating materials. The friction coefficient of natural diamond is approximately three times lower than that of deposited diamond. The value in air is close to 0.1, the value in vacuum can reach 1.0. This difference is due to the presence of adsorbed species and hydrogen as the ending of the emerging bonds in the first case, i.e. air.

In the case of the DLC films, lower friction coefficients are measured: 0.1-0.05 DLC/DLC. This can be explained by: i) the presence of hydrogen ending the emerging bonds which limit the adhesion phenomenon, and ii) the presence of Csp$^2$ atoms which leads to stronger bonds and then also limits the adhesion, favors a decrease of the surface roughness due to the bi-dimensional geometry induced by Csp$^2$. The tests performed on DLC coatings showed the obtained values of the friction coefficient are very weak, f=0.05-0.10 in air or in presence of water.

Cavidur is hard amorphous carbon coating (DLC) obtained through a PA-CVD process (deposition temperature: 160-350° C.) which was used in testing.

A 2-6 μm thick coating was applied and the test data shown in Table 2 below revealed low friction coefficients in different mediums, air, water, mud and for different opposing materials, which exhibited reduced friction coefficients and good anti-corrosion properties. Specifically, in the case of Cavidur/Cavidur contact, two points stood out: i) no galling-binding appeared (no damage was observed at the contact surface) and ii) the friction coefficient is very low and can be as low as 0.04. Note that metal-to-metal friction coefficients are typically above 0.2 and moreover the friction coefficient between metal and wellbore wall is likely to be even higher than that. Thus, it can be seen from FIG. 2 that all of the tested friction coefficient values are well below this.

TABLE 2

Tests performed for Cavidur coating.

| Samples | Medium | Opposing material | N (daN) | Rugosity | Friction coef. | Galling Binding |
|---|---|---|---|---|---|---|
| EF66 | air | Cavidur | 56 | 0.10 | 0.06 (1)/0.05 (25) | N(25) |
| EF67 | air | Cavidur | 110 | 0.10 | 0.09 (1)/0.04 (25) | N(25) |
| EF68 | air | Cavidur | 158 | 0.10 | 0.07 (1)/0.05 (50) | N(50) |
| EF69 | air | Cavidur | 210 | 0.10 | 0.12 (1)/0.05 (25) | N(25) |
| EF70 | air | Cavidur | 305 | 0.10 | 0.07 (1)/0.05 (25) | N(25) |
| EF71 | water | Cavidur | 52 | 0.10 | 0.10 (1)/0.04 (30) | N(30) |
| EF72 | water | Cavidur | 106 | 0.10 | 0.08 (1)/0.06 (20) | N(20) |
| EF73 | water | Cavidur | 211 | 0.10 | 0.07 (1)/0.06 (20) | N(20) |
| EF74 | water | Cavidur | 295 | 0.10 | 0.05 (1)/0.07 (25) | N(25) |
| EF75 | mud | Cavidur | 54 | 0.10 | 0.10 (1)/0.11 (25) | N(25) |
| EF76 | mud | Cavidur | 116 | 0.10 | 0.08 (1)/0.11 (25) | N(25) |
| EF77 | mud | Cavidur | 200 | 0.10 | 0.08 (1)/0.10 (40) | N(40) |
| EF78 | mud | Cavidur | 307 | 0.10 | 0.06 (1)/0.11 (50) | N(50) |

TABLE 2-continued

Tests performed for Cavidur coating.

| Samples | Medium | Opposing material | N (daN) | Rugosity | Friction coef. | Galling Binding |
|---|---|---|---|---|---|---|
| EF79 | air | 17-4 PH | 52 | 0.10 | 0.14 (1)/0.14 (15) | N(15) |
| EF80 | air | 17-4 PH | 106 | 0.10 | 0.14 (1)/0.16 (20) | N(20) |
| EF81 | air | 17-4 PH | 201 | 0.10 | 0.15 (1)/0.16 (20) | N(20) |

Several applications for coating of surfaces of downhole tools are now described.

Figure 3:
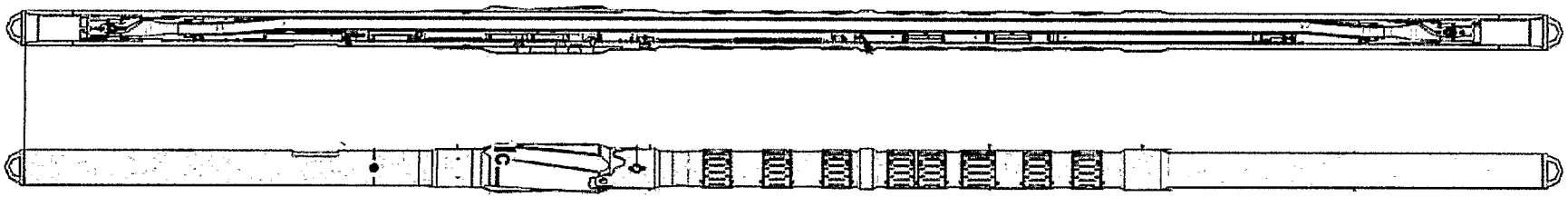
FIG. 3 shows an example of a LWD (Logging While Drilling) application.

FIG. 3 shows a LWD (Logging While Drilling) application for reducing corrosion and friction effects of LWD collars which is a common and widespread problem associated with LWD applications. The increasing number of directional and horizontal wells with the combination of rotating stresses, bending stresses and corrosion results in premature loss of the LWD collars. The use of DC or DLC coatings increases the life of the LWD collars. It should also be appreciated that drill collar for Measurement While Drilling (MWD) applications are equally suitable.

Figure 4:
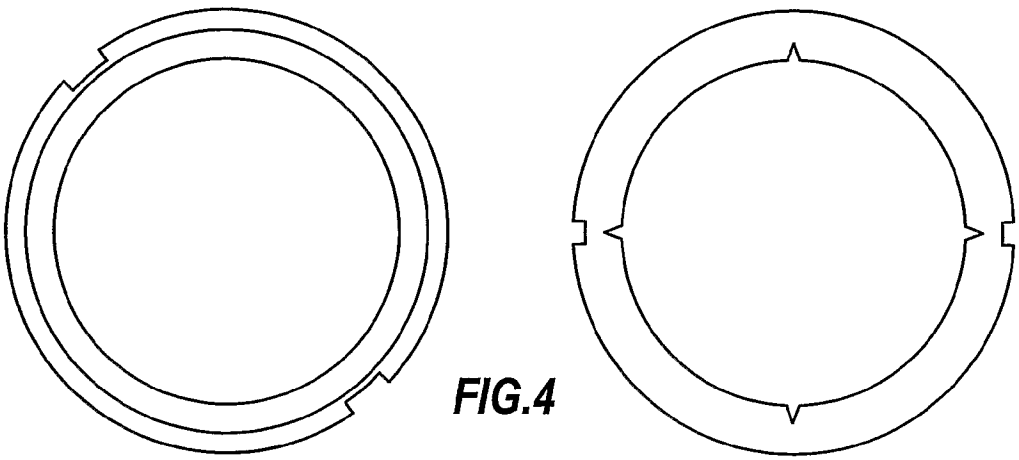
FIG. 4 shows an example of an O-ring application.

FIG. 4 shows a further application in which the coating can be used to protect small parts of a logging tool. This is particularly useful, for example, in protecting O-rings while operating in sliding mode FIG. 5 shows yet a further application in which the coating can be applied to rotating shafts where the seal is performed by O-rings. The o-ring/shaft seal can be improved by the reduction of the friction coefficient and the reduction of the associated wear.

FIG. 6 shows yet a further application in which the coating is applied to a pads of an imaging tool. The pad comprises an array of electrodes, but with the coatings, the surface friction between the pads and adjacent formation is reduced. That is, a widespread problem with imaging tools is that the pad of said tool is found to stick against the formation wall of the borehole. When the imaging tool is trying to be moved, the pad sticks to the wall resulting in a so-called "yo-yo" effect on the tool, which affects the image. Thus, a further advantage of application of the coating to the imaging tool is to reduce the yo-yo effect and hence improve the quality of the acquired image. The imaging tool could be an frequency based imaging tool, for example an FMI tool, but it should be appreciated that other imaging tools are also applicable.

It should be appreciated that other inert materials that are able to reduce both the friction and corrosion would also be applicable for downhole tools was carried out on PVD-CVD coatings such as TiN, TiCN, TiAlN, WC/C, etc.

The invention claimed is:

1. An apparatus, comprising:

a downhole logging tool operable to perform a logging operation within a borehole extending into a subsurface formation, wherein the downhole logging tool comprises:

a support body having a metallic surface; and a coating on at least a portion of the metallic surface of the support body, wherein the coating comprises an inert material operable to reduce friction between the metallic surface of the support body and the borehole a plurality of parts each comprising the coating on a corresponding metallic surface thereof, and wherein the coating is operable to reduce friction between each of the plurality of parts.

2. The apparatus of claim 1 wherein the coating comprising the inert material is further operable to reduce corrosion of the metallic surface of the support body.

3. The apparatus of claim 1 wherein the inert material comprises a diamond carbon film.

4. The apparatus of claim 1 wherein the inert material comprises a diamond-like carbon film.

5. The apparatus of claim 1 wherein the plurality of parts comprises a plurality of O-rings each comprising the coating on a corresponding surface thereof, and wherein the coating is operable to reduce friction between the plurality of O-rings and corresponding plurality of parts operable to slide relative to the plurality of O-rings.

6. The apparatus of claim 1 wherein the logging tool comprises a rotating shaft and at least one O-ring encircling the rotating shaft, and wherein a metallic surface of the rotating shaft and a surface of the at least one O-ring encircling the rotating shaft each comprise the coating in a manner operable to reduce friction between the rotating shaft surface comprising the coating and the at least one O-ring encircling the rotating shaft.

7. The apparatus of claim 1 wherein the downhole logging tool comprises a logging while drilling (LWD) tool, wherein the support body comprises a drill collar of the LWD tool, and wherein the drill collar comprises the metallic surface comprising the coating.

8. An apparatus, comprising:

a downhole logging tool operable to perform a logging operation within a borehole extending into a subsurface formation, wherein the downhole logging tool comprises:

a support body having a metallic surface;

a coating on at least a portion of the metallic surface of the support body, wherein:

the coating comprises an inert material operable to reduce friction between the metallic surface of the support body and the borehole;

the inert material is further operable to reduce corrosion of the metallic surface of the support body; and the inert material comprises a film selected from the group consisting of a diamond carbon film and a diamond-like carbon film;

a plurality of parts each comprising the coating on a surface thereof, wherein:

the coating is operable to reduce friction between ones of the plurality of parts;

the plurality of parts comprises a plurality of O-rings; and the coating is operable to reduce friction between ones of the plurality of O-rings and corresponding ones of the plurality of parts operable to slide relative to the ones of the plurality of O-rings; and a rotating shaft, wherein at least one of the plurality of O-rings encircles a metallic surface of the rotating shaft, and wherein the metallic surface of the rotating shaft comprises the coating in a manner operable to reduce friction between the rotating shaft surface comprising the coating and the at least one of the plurality of O-rings encircling the metallic surface of the rotating shaft.

9. The apparatus of claim 8 wherein the downhole logging tool comprises a logging while drilling (LWD) tool, and wherein the support body is a drill collar of the LWD tool.

10. A method, comprising:

depositing a coating on a plurality of parts of a downhole logging tool operable to perform a logging operation within a borehole extending into a subsurface formation, including:

depositing the coating on a metallic surface of a support body of the downhole logging tool, wherein:

the coating comprises an inert material operable to reduce friction between the metallic surface of the support body and the borehole;

the inert material is further operable to reduce corrosion of the metallic surface of the support body; and the inert material comprises a film selected from the group consisting of a diamond carbon film and a diamond-like carbon film;

depositing the coating on a surface of each of a plurality of parts of the downhole logging tool, wherein:

the coating is operable to reduce friction between ones of the plurality of parts;

the plurality of parts comprises a plurality of O-rings; and the coating is operable to reduce friction between ones of the plurality of O-rings and corresponding ones of the plurality of parts operable to slide relative to the ones of the plurality of O-rings; and depositing the coating on a metallic surface of a rotating shaft of the downhole logging tool, wherein at least one of the plurality of O-rings encircles the metallic surface of the rotating shaft, and wherein the coating on the metallic surface of the rotating shaft is operable to reduce friction between the rotating shaft surface comprising the coating and the at least one of the plurality of O-rings encircling the metallic surface of the rotating shaft.

11. The method of claim 10 wherein the downhole logging tool comprises a logging while drilling (LWD) tool, and wherein the support body is a drill collar of the LWD tool.

12. The method of claim 10 wherein each of the coating deposition steps comprises chemical vapor deposition of the coating.

13. The method of claim 10 wherein each of the coating deposition steps comprises physical vapor deposition of the coating.

* * * * *